United States Patent [19]

Houska et al.

[11] 4,322,280

[45] Mar. 30, 1982

[54] ELECTROLYSIS DEVICE FOR THE GALVANIC REINFORCEMENT OF TAPE-SHAPED PLASTIC FOILS WHICH ARE PRECOATED TO BE CONDUCTIVE

[75] Inventors: Karl H. Houska, Munich; Lothar Floegel, Neuried; Joachim Hauck, Taufkirchen, all of Fed. Rep. of Germany; Daniel Hosten, Handzame, Belgium; Wilfried Denys, Oostkamp, Belgium; Luc Boone, Oostkamp, Belgium; Marc De Vogelaere, Zedelgem, Belgium

[73] Assignee: Siemens Aktiengesellschaft, Berlin & Munich, Fed. Rep. of Germany

[21] Appl. No.: 198,181

[22] Filed: Oct. 15, 1980

[30] Foreign Application Priority Data

Dec. 11, 1979 [DE] Fed. Rep. of Germany ..... 2949741

[51] Int. Cl.[3] ..... C25D 7/06

[52] U.S. Cl. ..... 204/207; 204/202; 204/203; 204/206; 204/211; 204/228; 204/229; 204/274; 204/279

[58] Field of Search ..... 204/202, 203, 204, 205, 204/206, 210, 211, 279, 300, 207, 228, 229

[56] References Cited

U.S. PATENT DOCUMENTS

| | | | |
|---|---|---|---|
| 2,236,861 | 4/1941 | Widell | 204/300 EC |
| 2,882,214 | 4/1959 | Summers et al. | 204/206 X |
| 2,969,437 | 1/1961 | Rayburn | 204/279 X |
| 3,261,770 | 7/1966 | Judge | 204/206 X |
| 3,359,190 | 12/1967 | Cooke et al. | 204/206 X |
| 3,645,856 | 2/1972 | Schulze | 204/279 X |
| 3,933,611 | 1/1976 | Dudley | 204/300 EC |
| 3,964,989 | 6/1976 | Ackerly et al. | 204/279 X |

*Primary Examiner*—Arthur C. Prescott

*Attorney, Agent, or Firm*—Hill, Van Santen, Steadman, Chiara & Simpson

[57] ABSTRACT

An electrolysis device for electrolytic deposition of a metal on at least one surface of the tape which has been precoated with a metal provides an electrolytic metal deposition band in which there is a first electrode for connection to a first voltage source. A tape drive is provided for moving the tape through the bath including first guide rollers defining a single loop for the tape through the bath. A second electrode is provided in the tape path and mounted to contact the tape above the entrance to the bath and over an area of the one metallized surface and is connected to a second source potential. Second guide rollers along the tape path downstream of the bath, including a second guide roller contact the metallized surface and is connected to a third source potential.

14 Claims, 4 Drawing Figures

ELECTROLYSIS DEVICE FOR THE GALVANIC REINFORCEMENT OF TAPE-SHAPED PLASTIC FOILS WHICH ARE PRECOATED TO BE CONDUCTIVE

BACKGROUND OF THE INVENTION

1. Field of the Invention

The present invention relates to an electrolysis device for the galvanic reinforcement of tape-shaped plastic foils which are precoated to be conductive, and which run through an electrolysis bath in vertical loops, the electrolysis bath including an electrolysis tank having vertical anode plates which are arranged parallel to the tape path and the device being provided with guide and contacting rollers which are arranged above the bath, and with a washing station and a drying station.

2. Description of the Prior Art

In the German published application No. 1,521,076, a device is specified for the plating of a strand of plastic, wherein by means of chemical deposition, first a metal layer of extremely small thickness is generated on the plastic, which layer is then electrolytically reinforced. For the electrolytic reinforcement, the precoated strand is guided in a multiplicity of loops through an electrolysis bath which has an electrolysis tank with vertical anode plates arranged parallel to the path of travel of the strand and which has guide and contacting rollers arranged above the bath. In this device, the three first loops are kept significantly shorter than the following loops and are connected to different voltages so that to some extent they are to be viewed as independent electrolysis cells. At the first guide and contacting rollers, a voltage of approximately 15 V is applied, at the second a voltage of 5 V is applied and at the remaining rollers a voltage of 2 V is applied. The decreasing of the loop length and graduation of the voltages in the first electrolytic cells occurred because it was not possible to maintain a voltage in the first loop which is necessary for the electroplating process of the strand. Because of the extremely small thickness of the chemically-generated metal coating a loop normal length would lead to such an increase of the resistance in the thin metal layer that an electrolysis would hardly take place.

SUMMARY OF THE INVENTION

The present invention is based upon the problem of creating an electrolysis device for the galvanic reinforcement of tape-shaped plastic foils which are precoated to be conductive, which device operates satisfactorily with significantly fewer loops for the decreasing of the expense, particularly, the device suffices with only a single loop.

This problem is solved and the object of the invention achieved, in that the plastic tape which is precoated to be conductive is contacted directly before immersion in the electrolysis bath by a loop cathode arrangement which is arranged perpendicular to the direction of movement of the plastic tape and is contactable after the exit from the electrolysis bath in a manner known per se by guide and contacting rollers and in that the loop cathodes of the loop cathode arrangement and the guide and contacting rollers are connected with their own respective current sources which are galvanically separated from one another.

Because the conductively precoated plastic tape is contacted directly before the immersion into the electrolysis bath, the length and therefore the resistance of the current carrying thin metal layer is limited to a minimum, so that the lead-in current can be operated at a lower voltage and therefore higher currents than in the case of the known device.

Nevertheless, it has been determined that in the lead-in circuit, despite this, only a little current flows if the cathodes of all current sources are connected to one another. However, if one connects the loop cathodes and the contacting rollers with their own current sources which are galvanically separated from one another, the lead-in current increases and one obtains a higher growth rate of the metal layer. This has the result that after the immersion, already an intensified plating can take place so that necessarily also the following guide and contacting rollers may be loaded to a higher degree. This again offers the advantage that for a specific cases of application, the plastic tape needs to be guided through the electrolysis bath in only a single loop, whereby the expense and the structural length of the device decreases quite significantly.

In order to attain a good contacting of a plastic tape which is coated on both sides, rod-shaped loop cathodes are provided on both sides of the tape and are designed with arcuate surfaces on the sides facing the plastic tape, the cathodes being arranged offset from one another in the direction of movement of the tape in such a manner that the plastic tape which is guided between the loop cathodes brushes over the cathodes one after the other in an area-contacting manner, the tape following a shallow S-shaped bath in this area.

In the case of an available device, a raising of the throughput in the case of a pregiven layer thickness is practically only possible in that the current and the running speed are correspondingly raised. However, the maximum allowable current is limited by the resistance of the metal layer. Since this resistance is, however, temperature-dependent, according to a further development, the current can also be raised in that the plastic tape or, respectively, the metal layer, can be cooled at and directly after the loop cathode arrangement and at and before the guide and contacting rollers. Preferably, the precoated or respectively, reinforced, plastic tape may be cooled at and after the rod-shaped electrodes by compressed air and at and before the contacting rollers by the path liquid or, respectively, water.

In order to attain a uniform layer thickness over the entire width of the plastic tape, in a manner which is known per se, on both sides of the plastic tape, plastic shields are provided, which according to the invention are adjustable, for the accommodation to the tape width and the current density distribution, perpendicular to the direction of travel of the tape. Furthermore, it has been shown that if at the inlet and/or outlet side, one inserts a shield over the entire width of the plastic tape from above down into the bath, the current can be increased at the inlet side or, respectively, outlet side without the copper layer being damaged. This shield takes care of a uniform current density distribution at the inlet side or, respectively, the outlet side.

If plastic tapes which are coated only on one side are to be reinforced, then only the corresponding loop cathodes or, respectively, contacting rollers are connected with the corresponding current sources. For better evaluation of the device, according to a further development, two plastic tapes which are coated on one side are treated simultaneously, whereby the tapes are put together in such a manner that the coated sides are on the outside. This can be realized with only slight additional expense in that a further feed roller and a further take-up roller are provided for the second plastic tape.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
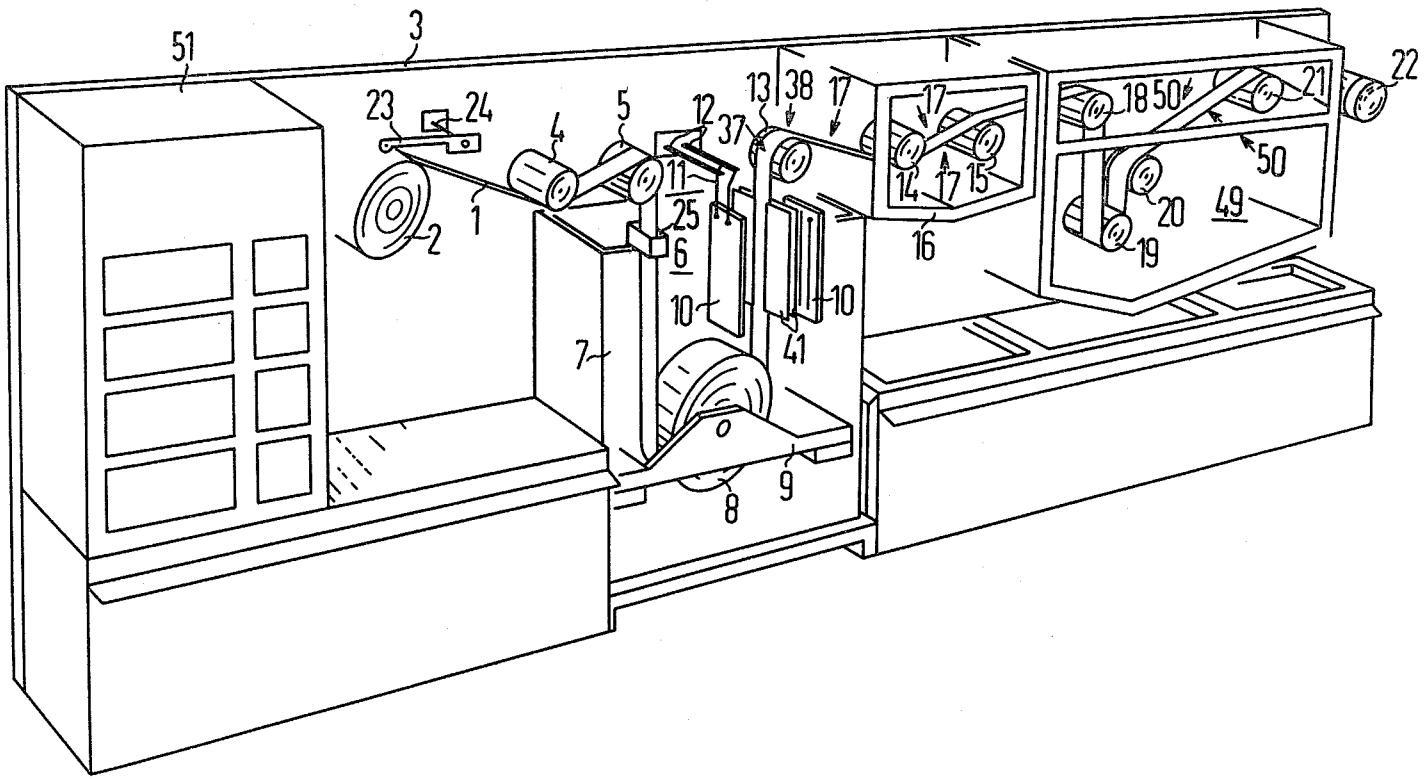
FIG. 1 is a pictorial representation, shown partially cut away, of an electrolysis device constructed in accordance with the present invention.

Referring to FIG. 1, the drawing shows, in principle, an electrolysis device for the galvanic reinforcement of a plastic tape which is precoated to be conductive. A plastic tape 1 is pulled from a feed roller 2 which is rotatably mounted on a housing wall 3 and is in driving connection with a brake motor (not shown). The brake motor provides for maintaining a constant tensile force in the plastic tape 1. By way of a pair of guide rollers 4 and 5, the plastic tape 1 is fed into an electrolysis bath 6 which comprises a container 7 in which a pulling roller 8 is rotatably mounted on a frame 9. In the container 7 a plurality of rigidly arranged anode plates 10 are provided, which plates 10 are arranged on both sides of the descending and ascending plastic tape 1 and are connected by way of lines 11 with anode leads 12 of individual current sources (not shown). Lying opposite the guide roller 5, a guide roller 13 is provided by way of which the plastic tape 1 exiting from the electrolysis bath 6 is supplied to a pair of guide and contacting rollers 14 and 15 which are located in a washing station 16. Two guide and contacting rollers are required if the plastic tape is precoated on both sides and both sides are to be galvanically reinforced. Spray nozzles for water are symbolized by arrows 17 for the cleaning of the reinforced tape 1 of electrolyte which is still adhering. By way of further guide rollers 18–21, the reinforced plastic tape 1 is fed, via a drying station 49, to a take-up roller 22 which is also rotatably mounted on the housing wall 3 and is provided with a drive motor (not shown). Both the feed roller 2 and the take-up roller 22 are provided with measuring devices 23 which, via control shafts 24, are connected with potentiometers for the rotational speed control of the brake and drive motors. These potentiometers are not shown in the drawing, as the same are located behind the housing wall 3.

Figure 2:
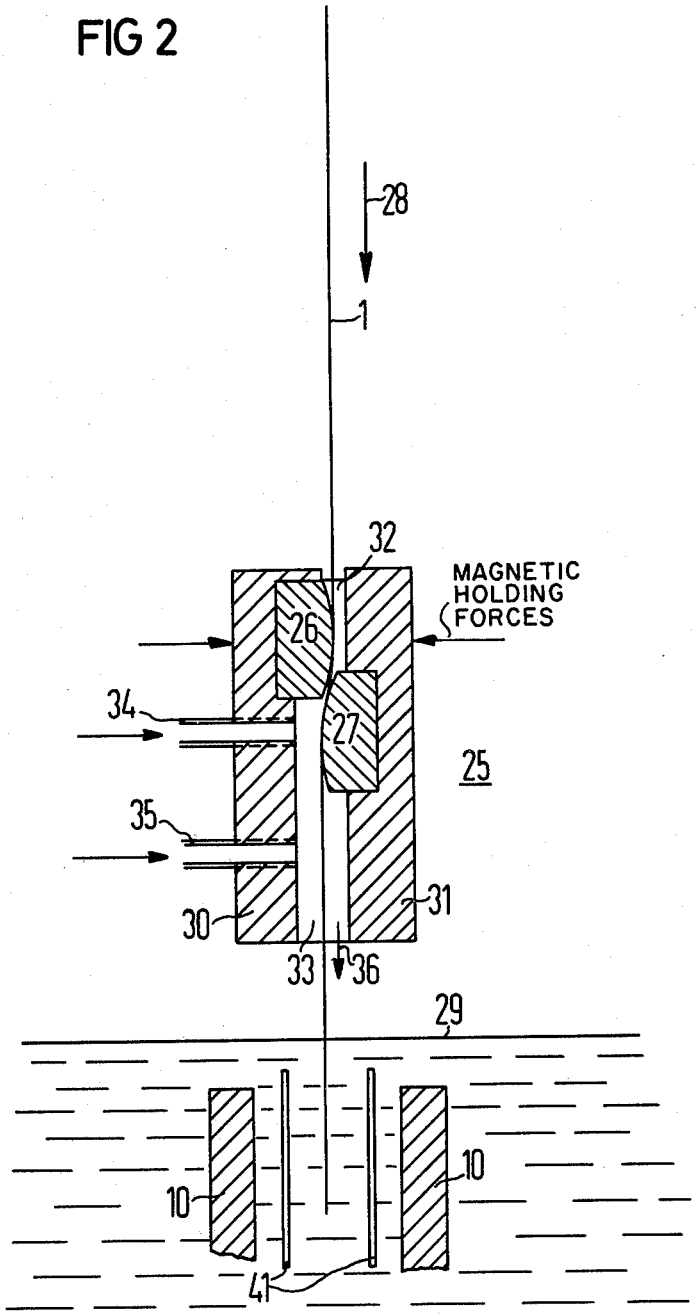
FIG. 2 is a schematic representation of the cathode structure above the bath and of an anode structure in the bath.

In the case of the devices which were heretofore customary, to the extent that in each case a conductive layer is applied on both sides of the plastic tape, the two guide rollers 4 and 5 are also designed as contacting rollers. Since the metallic precoating of the plastic tape 1 usually is applied by chemical deposition or by spraying, this metal layer displays an extremely slight thickness which, in the case of normal loop length, has such a high resistance that the lead-in circuit is only in the position of carrying very little current, so that hardly any electrolysis takes place, and the deposition is therefore extremely small. A possible increase of voltage or, respectively, current nevertheless would lead to the burning of the burning of the precoating. For this reason, for example, in the case of the known electrolysis devices, the pretreated plastic web is guided through the electrolysis bath in a multiplicity of loops, particularly shortened loops. Since, in this case, a guide and contacting roller must be associated with each loop, this known electrolysis device requires a great expense, in particular when a thicker layer is to be applied in a galvanic manner. These difficulties are eliminated in the case of a device constructed in accordance with the present invention in that, basically, the plastic tape 1 is contacted directly before immersion into the electrolytic bath 6, and specifically with a help of a loop cathode arrangement 25 which is arranged perpendicularly to the plastic tape 1. As is illustrated in FIG. 2, this cathode arrangement has two loop cathodes 26 and 27 which are arranged on both sides of the plastic tape 1. The loop cathodes 26 and 27 are designed as rods which have, on the sides facing the plastic tape 1, arcuate surfaces, and the rods are displaced with respect to one another in the direction of movement of the tape (arrow 28) and in a direction toward one another, to provide a shallow S-shaped tape path so that the rod-shaped loop cathodes 27 and 28 are wiped over area-wise by the respective sides of the tape. By means of the arrangement of the loop cathodes 26 and 27 in the direct vicinity of the surface 29 of the electrolytic bath 6, the current carrying a portion of the coating which extends outside of the electrolytic bath 6 is extremely short, the resistances therefore relatively low in contrast to the known arrangements. Thereby, a significantly higher galvanizing current and, therefore, a significantly higher rate of deposition is possible, so that one can practically suffice with a single loop, as illustrated in FIG. 1. The arcuate surfaces of the loop cathodes are as smooth as possible, in order, on the one hand, to obtain low frictional resistance and, on the other hand, to obtain a good current transfer.

An additional increase of the galvanizing current is also possible in that both the incoming and the outgoing current carrying portion of the plastic tape 1 is cooled. In the case of the embodiment illustrated in FIG. 2, on the inlet side, preferably an air cooling is employed which starts directly at the loop cathode arrangement 25. The loop cathodes 26 and 27 are inserted in supports 30 and 31, respectively, which, for example, are pressed against one another with the help of magnetic means (not illustrated). With this structure, the loop cathodes 26 and 27 are removed from one another to such an extent that the plastic tape 1 can easily be moved through the shallow S-shaped path. For air cooling, the two supports are provided with chambers 32 and 33 which are supplied by way of passageways 34 and 35 which compressed air which then cools the tape in the chambers 32 and 33 and can escape downwardly as indicated by an arrow 36. Therefore, the current can be additionally increased in the lead-in circuit.

The plastic tape 1 which exits from the electrolytic bath 6 is also cooled, and specifically once by means of the spraying with wash water in the washing station 16 by means of a spray nozzle 17, which was already mentioned, and again by means of spraying with the bath liquid by means of a spray nozzle indicated by an arrow 37 until the same is near the crown of the guide roller 13. Directly after the crown of the guide roller 13, the spraying with wash water proceeds by a further nozzle which is symbolized by means of an arrow 38. The spraying does not serve only for cooling, but also for the avoidance of flaw formations of the galvanically-applied deposit due to adhering electrolytes.

In order to attain a uniform layer thickness over the total width of the plastic tape, on both sides of the tape and laterally with respect to the same, plastic shields 40 and 41 are provided which screen the tape edges with respect to the anode plates 10. The shields are arranged adjustable cross-wise with respect to the direction of movement of the tape for the accommodation of the tape width and the current density distribution. The plastic shields 40 and 41 cover the edges of the plastic tape 1 with respect to the anode plates 10 over the entire length thereof. These plastic shields 40 and 41 are represented, for the sake of an overview, only for the exiting loop portion, as the anode plates 10 are also so presented. They are, of course, also provided in the case of the anode plates of the incoming loop portion, as are the anode plates 10.

Figure 3:
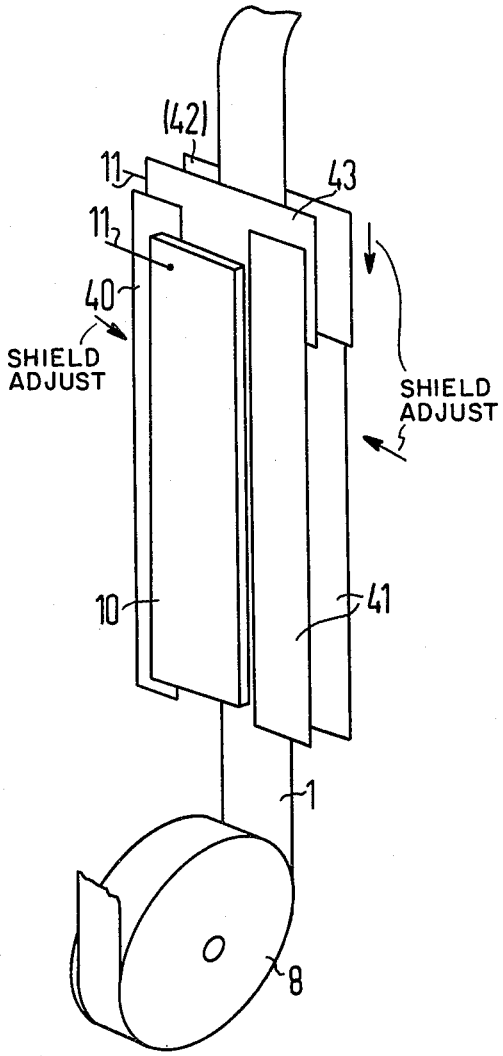
FIG. 3 is a perspective view of the anode and shield structures in the electrolytic bath.

At the outlet side for the plastic tape 1, preferably there are further plastic shields 42 and 43 which are introduced from above into the bath to a depth of approximately 20 cm, that is between the tape and the anode plates. With this arrangement, a better current density distribution is attained at the anode plates 10 so that the current can be further increased at the outlet side without a burning of the layer occurring. FIG. 3 illustrates the arrangement of the plastic shields with respect to the plastic tape 1. Such plastic shields can also be provided on the inlet side. In many cases, a coating, or respectively, a reinforcement, of the plastic tape is only needed on one side. In this case, either only the loop cathode 26 and the contacting roller 15 or only the loop cathode 27 and the contacting roller 14 require the application of voltage, depending on which side of the plastic tape is precoated. In the case of precoating of the plastic tape on only one side, it is advantageous for the increase of throughput if, according to a further development, two plastic tapes which are coated on one side are put together in such a manner that the metal coating is on the outsides of the two tapes, when considered together.

Figure 4:
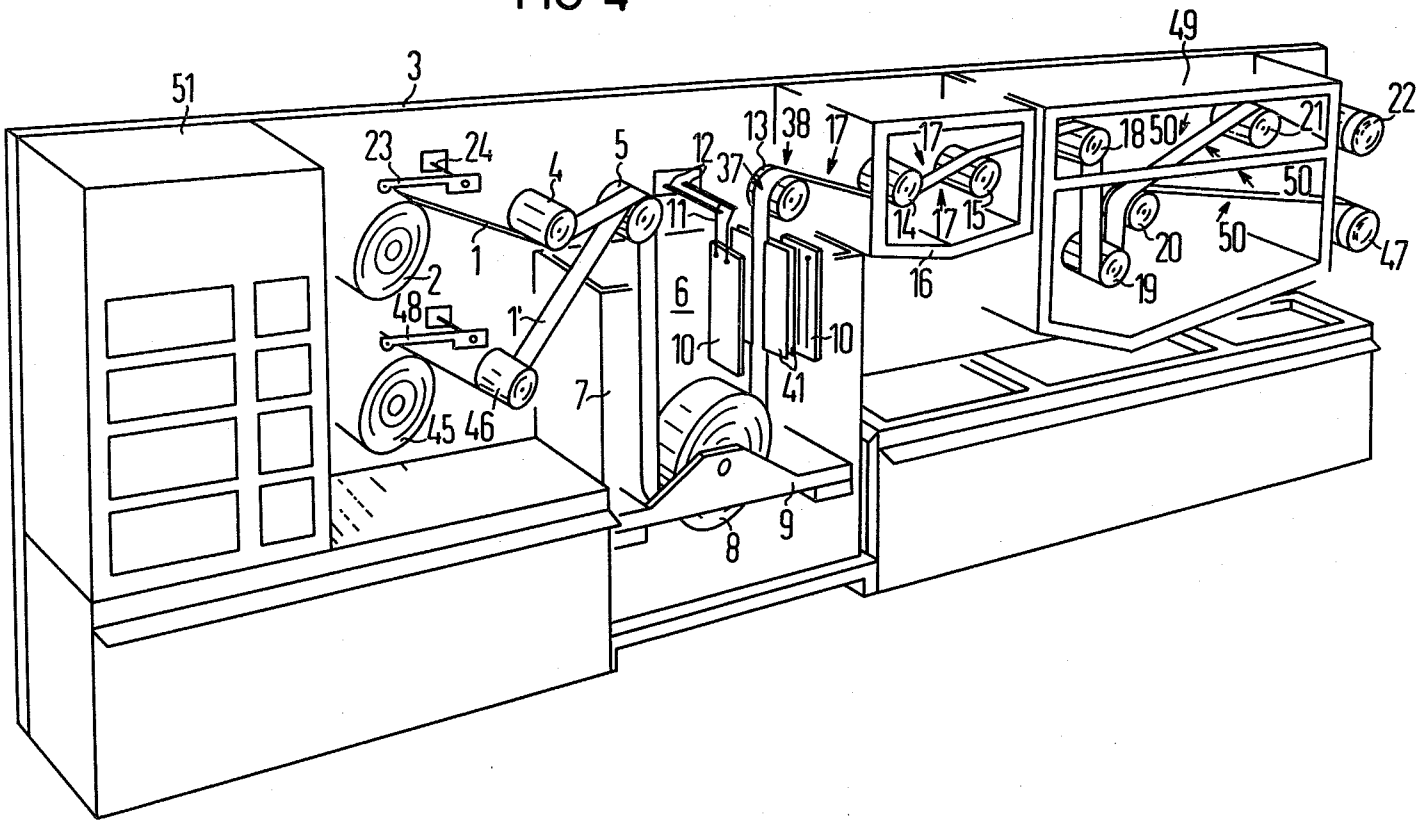
FIG. 4 is a pictorial representation, shown partially cut away, of an electrolysis device constructed in accordance with the present invention for the plating of two plastic tapes which are each coated on one side.

FIG. 4 illustrates an embodiment of the invention for an electrolysis device for two tapes. In this case, a further feed roller 45 is provided for a second plastic tape 1' which is fed by way of a guide roller 46 to the guide roller 5. From there, it is then guided further, together with the plastic tape 1, to the guide roller 20 and is finally wound up again onto a take-up roller 47. The feed and take-up rollers 45 and 47 are also provided with measuring devices 48 for the determination of the diameter in order to be able to correspondingly control the drive and brake motors, which are not illustrated on the drawing, with respect to their rotational speed. The guide rollers 18–21 are located in a drying container or station 49 in which the plastic tapes are dried on all sides with the help of blowers. Arrows 50 illustrate the direction of application of the blowers which are not illustrated in detail for the sake of simplicity. The preferably electronic control unit of the electrolysis device is housed in a control case 51 (FIGS. 1 and 4).

Instead of the anode plates 10 or, respectively, in addition to the same, anode bodies can be employed which can be inserted without interruption of the electrolysis process.

In the case of an embodied installation for the reinforcement of a metal-coated plastic tape, a polyimide foil of 25 μm tape thickness and 120 mm tape width was used. Before the galvanic reinforcement, on one or both sides of this polyimide foil, a CrNi layer is deposited and upon this layer a Cu layer is provided, whereby, the CrNi layer amounted to 100–200 Å and the Cu layer amounted to 500–600 Å. The Cu layer could be reinforced by the electrolysis device of the present invention to 20 μm. As an electrolysis bath, an acidic copper bath was used with a maximum deposition rate of 0.6 μm per minute. The inlet current amounted to 3.5 A and the outlet current amounted to 35 A. The plastic tape was guided in only a single loop through the electrolysis bath 6, whereby the length of the tape in the copper bath amounted to 2 m. The tape velocity amounted to 0.5 m/min. Such plastic tapes serve for the production of components which are integrated on plastic carriers, such as capacitors, crossovers, conductor paths, resistors and feedthroughs (throughplatings).

In still larger layer thicknesses are to be attained, the tape can be guided once again or several times more through the electrolysis path, whereby the current intensities can be correspondingly multiplied.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An electrolysis device for electrolytic deposition of a metal on at least one surface of a tape which has been precoated with a metal on that surface, comprising:

an electrolytic metal deposition bath;

first electrode means in said bath for connection to a first pole of a source;

tape drive means for moving the tape through the bath including first guide rollers defining a single tape loop through the bath;

second electrode means in the tape path and mounted immediately above the bath to provide areal wiping contact of the tape over an area of the one metallized surface immediately prior to entrance into said bath and connected to a second pole of the source; and second guide rollers along the tape path downstream of the bath including a second guide roller contacting the metallized surface and connected to a respective source.

2. The electrolysis device of claim 1, wherein both sides of the tape are precoated with metal, and wherein:

said second electrode means comprises first and second electrodes including respective rods each including an arcuate-shaped surface and positioned with respect to one another to provide an S-shaped portion of the tape path for areal wiping contact with both metallized surface of the tape.

3. The electrolysis device of claim 1, and further comprising:

cooling means mounted for and operative to cool the tape after leaving said bath.

4. The electrolysis device of claim 1, and further comprising:

cooling means mounted for and operative to cool the tape at said second electrode means.

5. The electrolysis device of claim 4, wherein:

said cooling means comprises chamber means defining at least one chamber including first and second electrodes therein and ports communicating with said chamber for supporting a flow of a coolant therethrough.

6. The electrolysis device of claim 5, wherein:

said chamber means comprises a pair of chamber parts shaped to define the chamber and mounting respective ones of said electrodes.

7. The electrolysis device of claim 6, and further comprising:

magnet means operable to hold said parts together.

8. The electrolysis device of claim 1, and further comprising:

cooling means spraying electrolyte on the tape at the exit from said bath.

9. The electrolysis device of claim 8, and further comprising:

additional cooling means spraying the tape with a coolant after the spraying with the electrolyte.

10. The electrolysis device of claim 9, wherein the additional cooling means comprises:

water spraying means.

11. The electrolysis device of claim 1, wherein said first electrode means comprises:

electrodes; and shields arranged on each side of the tape path.

12. The electrolysis device of claim 1, and further comprising:

shield means adjustably mounted for downward positioning into the bath adjacent said first electrode means.

13. The electrolysis device of claim 1, wherein two tapes are to be fed, each of which is metallized on one side, wherein:

said drive means drives the two tapes together with the metallized surfaces on the outside; and said second electrode means contacts both of the metallized surfaces.

14. The electrolysis device of claim 1, and further comprising:

drying means positioned downstream of said bath including blower means blowing on the tape.

* * * * *